United States Patent [19]

Burrell

[11] Patent Number: 4,560,072

[45] Date of Patent: Dec. 24, 1985

[54] DISPLAY AND STORAGE RACK

[76] Inventor: Alfred A. Burrell, 10223-133th St., Edmonton, Alberta, Canada

[21] Appl. No.: 469,308

[22] Filed: Feb. 24, 1983

[51] Int. Cl.[4] ..... A47F 5/08

[52] U.S. Cl. ..... 211/75; 211/88; 211/131; 211/126; 312/245

[58] Field of Search ..... 211/90, 88, 188, 194, 211/75, 74, 71, 163, 131, 126, 184, 187; 312/245, 246, 242, 234.4, 234.5

[56] References Cited

U.S. PATENT DOCUMENTS

| | | | |
|---|---|---|---|
| 2,905,336 | 9/1959 | Higberg | 211/184 |
| 3,146,739 | 9/1964 | Furman | 312/245 X |
| 3,375,936 | 4/1968 | Kessler . | |
| 3,489,475 | 1/1970 | Boyce et al. | 312/234.4 X |
| 3,504,956 | 4/1970 | Schottland | 211/184 X |
| 3,729,113 | 4/1973 | Lopatka | 312/247 X |
| 3,811,745 | 5/1974 | Cylke | 312/245 X |
| 3,868,021 | 2/1975 | Heinrich | 211/184 |
| 4,160,570 | 7/1979 | Bridges | 312/245 |
| 4,181,382 | 1/1980 | Harvey | 211/90 X |
| 4,365,855 | 12/1982 | Mark | 312/245 X |

FOREIGN PATENT DOCUMENTS

| | | | |
|---|---|---|---|
| 694795 | 9/1965 | Italy | 312/234.4 |

*Primary Examiner*—Robert W. Gibson, Jr.

*Attorney, Agent, or Firm*—Kenyon & Kenyon

[57] ABSTRACT

A rack and system of racks for holding objects for storage or display. The racks comprise spaced planar sides normally vertically oriented, the sides each having top, bottom, front and back edges. A rectangular base panel is provided extending between the sides, along the length of their bottom edges. A rectangular top panel is also provided extending between the sides along a portion of the length of their top edges from the back. The rack has an open back with the back edges of the sides having outwardly, oppositely extending flanges for mounting the rack. The front of the rack may be open or it may be provided with a planar rectangular front panel extending between the sides along a portion of the length of their front edges from the bottom, the front sections being normally vertically oriented. The top edge of the front panel and the front edge of the top panel leave a sufficient opening to the interior of the rack from the front or top for objects to be manually placed thereon or removed therefrom. A number of racks according to the present invention maybe fitted in a grooved backing panel, which backing may be for example wall mounted. This storage rack and storage rack system is very versatile, permitting modification to a large number of variations for holding for storage or displaying a great variety of shapes and sizes of objects.

16 Claims, 5 Drawing Figures

DISPLAY AND STORAGE RACK

FIELD OF THE INVENTION

The present invention relates to a storage rack for holding objects for storage or display, and a system incorporating one or more such racks.

BACKGROUND OF THE INVENTION

Storage systems, and particularly storage systems for small and medium sized objects, which have been developed until now have very often been limited in their application and use. There are very few such systems available today which are appropriate for industrial or commercial storage, on the one hand, and yet which are suitable or readily adaptable for storing or displaying stock in display and sales areas of a store or for storing objects in a home environment. A system for storage or display comprising a series of spaced storage racks provides a very efficient use of space available for storage or display. Such systems often use racks or bins which are located one above the other in fixed positions. Known storage rack systems of this type are described and illustrated, for example, in Browne Canadian Pat. No. 1,013,297 issued July 5, 1977 and Joyce Canadian Pat. No. 904,187 issued July 4, 1972. Hanson Canadian Pat. No. 759,800 issued May 30, 1967 describes and illustrates a multiple-purpose storage unit having a series of spaced plates which may serve as shelves when oriented horizontally, or which may be oriented in other directions to alter the function of the storage unit.

It is an object of the present invention to provide a multiple-purpose rack for holding for storage or display purposes medium and small sized objects. It is a further object of the present invention to provide such a storage rack which can be associated with other such racks for efficient utilization of space in storage or display areas.

SUMMARY OF THE INVENTION

According to the present invention a rack and system of racks is provided for holding objects for storage or display. The racks comprise spaced planar sides normally vertically oriented, the sides each having top, bottom, front and back edges. A rectangular base panel is provided extending between the sides, along the length of their bottom edges. A rectangular top panel is also provided extending between the sides along a portion of the length of their top edges from the back. The base and top panels are normally oriented substantially horizontally. The rack has an open back with the back edges of the sides having outwardly, oppositely extending flanges for mounting the rack. The front of the rack may be open or it may be provided with a planar rectangular front panel extending between the sides along a portion of the length of their front edge from the bottom, the front sections being normally vertically oriented. The top edge of the front panel and the front edge of the top panel leave a sufficient opening to the interior of the rack from the front or top for objects to be manually placed thereon or removed therefrom. A number of racks according to the present invention maybe fitted with their flanges in grooves of a backing panel, which backing panel may be for example wall mounted, provided with hinges to be mounted on a cabinet structure, or mounted on a floor stand structure.

In one embodiment of the present invention, the front panel is releasably attached to the sides of the rack so that it may be removed as required. A bar may be provided extending between the upper front areas of the sides to provide protection against objects supported on the base becoming accidently dislodged in a forward direction.

The rack according to the present invention is preferably provided with interior grooves, wherein inner surfaces of (1) at least two of the top panel, (2) base panel and (3) front panel are provided with a series of aligned laterally extending pairs of spaced shoulders forming grooves therebetween. These slots receive in normally vertical orientation from top to bottom and front to back alignment partition members to divide the interior of the rack into two more sections. Vertical partitions as required may be inserted, from the open back, into these aligned pairs of shoulders to subdivide the rack accordingly.

A storage system may be provided using racks according to the present invention. The system comprises one or more storage racks and a planar backing section. The backing section is provided with spaced, inwardly oriented grooves which receive the oppositely extending flanges of the rack in secure but releasable engagement.

Other aspects of the invention will be described in more detail subsequently. Even from the above however, it will be readily understood that an extremely versatile storage rack and system can be provided according to the present invention in which a basic storage rack can be modified and sub-divided in several different ways to permit the individual racks to serve a wide variety of functions in holding for storage or display a wide variety of objects. As well, in conjunction with appropriate backing panels for the racks, a versatile storage system which may be wall mounted, hinged to a cabinet structure or the like, or mounted on a floor stand, can be provided.

BRIEF DESCRIPTION OF THE DRAWINGS

These and other objects and advantages of the invention will become apparent upon reading the following detailed description and upon referring to the drawings in which.

Figure 2:
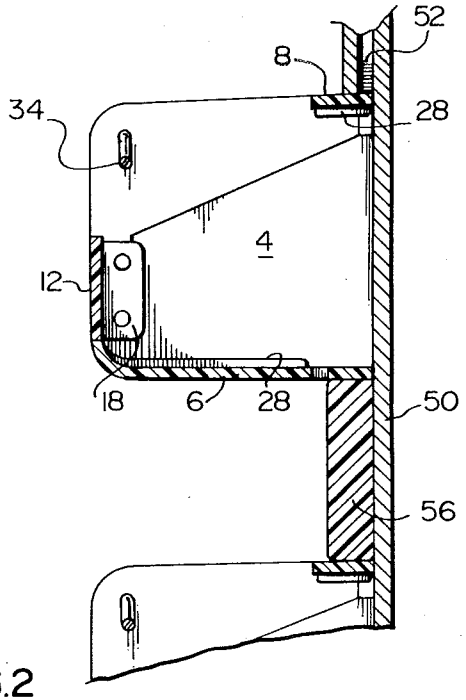
FIG. 2 is a side section view along line II—II of FIG. 1.

While the invention will be described in association with example embodiments, it will be understood that it is not intended to limit the invention to such embodiments. On the contrary, it is intended to cover such alternatives, modifications and equivalents as may be defined within the spirit and scope of the invention as defined by the appended claims.

DETAILED DESCRIPTION OF THE INVENTION

In the following description, similar features in the drawings have been given similar reference numerals.

Figure 1:
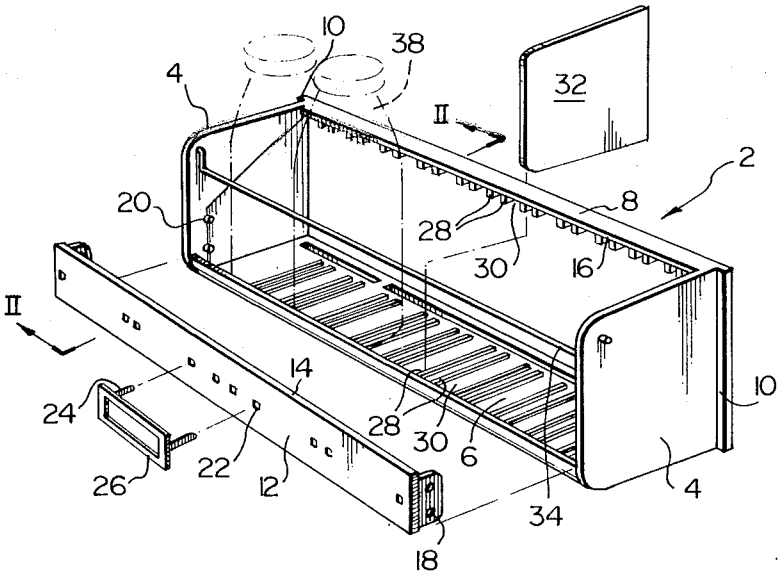
FIG. 1 is a perspective view, from the front, of an example embodiment of a storage rack according to the present invention, certain elements of which are illustrated in exploded fashion.

Turning to FIG. 1 there is shown a storage rack 2 for holding for display or storage, stock or other items. The rack comprises spaced planar sides 4 which are normally vertically oriented. A rectangular base panel 6 extends between sides 4 along the length of their bottom edges and a rectangular top panel 8 extends between sides 4 along a rear portion of the length of the top edges of the sides from the back. The base and top panels are normally oriented substantially horizontally, although, as can be seen from FIG. 2, they are both slightly inclined, as are the top and bottom edges of sides two, towards each other approaching the front. The back of rack 2 is essentially open. The back edges of sides 4 are provided with outwardly, oppositely extending flanges 10 which, as will be explained in more detail hereinafter, are used for mounting the rack.

Extending between sides 4 of the rack along a portion of the length of their front edge, from the bottom, is planar rectangular front panel 12. The top edge 14 of front panel 12 and the front edge 16 of top panel 8 leave a sufficient opening to the interior of the rack (FIG. 2) from the front or top to permit objects to be manually placed therein or removed therefrom. Front panel 12 may be of integral construction with sides 4 and base panel 6, or, as illustrated in FIG. 1, it may be provided with means 18 for releasably attaching to co-operating means 20 on the interior surface of sides 4 so that front panel 12 may be removed as required to provide rack 2 with an open front. Perforations 22 are regularly spaced across front panel 12 to receive attachment ears 24 of label receptacles 26, so that the contents in a particular portion of rack 2 may be labelled or identified.

Co-operating pairs of shoulders 28 provide spaced grooves 30 extending laterally from front to back on the inner surfaces of base panel 6 and top panel 8 the shoulders and grooves of the base panel 6 being aligned with those of top panel 8 to receive in vertical orientation partition section 32 extending from top to bottom of the rack, enabling the interior of rack 2 to be sub-divided into sections located as required and of a size as releasonably small as required.

A bar 34, being for example a metal wire or the like, may be provided extending between the upper front areas of sides 4. The ends of the bar 34 which are releasably secured in corresponding holes in sides 4, to provide protection against objects such as bottles 38 which may be supported on the base panel 6 from becoming unintentionally dislodged in the forward direction, a danger which would particularly exist if front panel 12 is not used. Such a construction of rack 2 would be ideally suited to displaying small bottles or the like for retail sale. The bottles are openly visible for display purposes, yet bar 34 would act as a barrier, by bearing against the neck portions of bottles 38, to prevent them from being accidently dislodged from rack 2.

Figure 3:
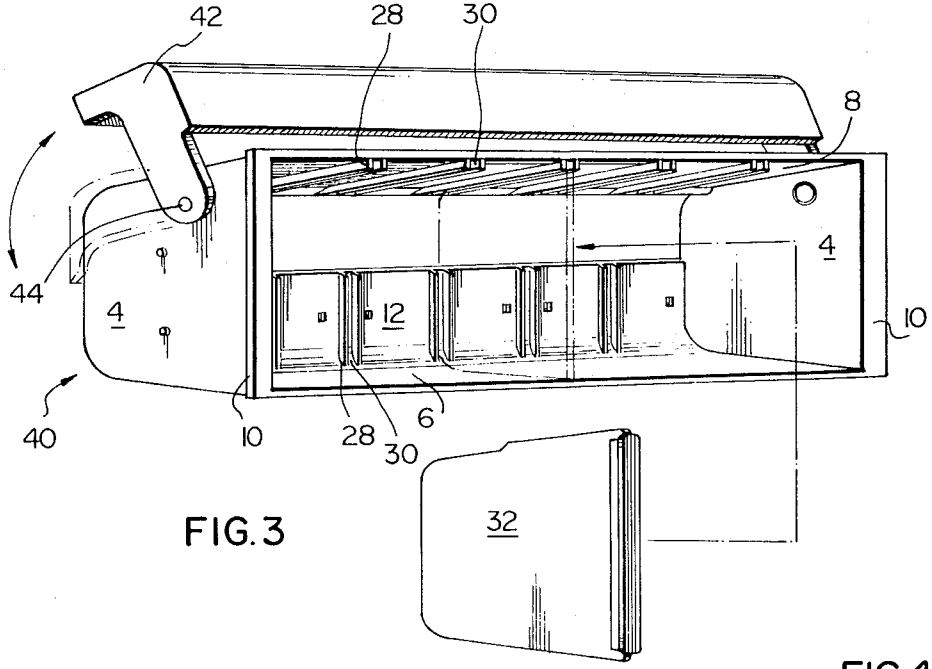
FIG. 3 is a perspective view, from the back, of a further embodiment of storage rack according to the present invention.

Turning to FIG. 3 there is shown a rack 40, somewhat similar to rack 2 of FIGS. 1 and 2, but being provided with a closure flap 42 hingedly secured at 44 to the sides 4 of rack 40. Closure flap 42 may be transparent, for display purposes, or nontransparent if rack 40 is intended solely for storage purposes. It will be noted that top panel 8 of rack 40 extends forwardly a greater distance than top panel 8 of rack 2. There remains however a sufficient space for opening to the interior of the rack 40 from the front or top to permit stock to be placed on or removed from that rack. Laterally extending shoulders 28 and grooves 30 are also provided within rack 40, on the inner surface of top panel 8, as in the case of rack 2, and from bottom to top on the inner surface of front panel 12. Grooves 30 of the top panel 8 and front panel 12 of rack 40 are aligned so that co-operating pairs of such grooves to hold partition sections 32 as required in vertical orientation, sub-dividing the inner volume of rack 40 as required.

Figure 4:
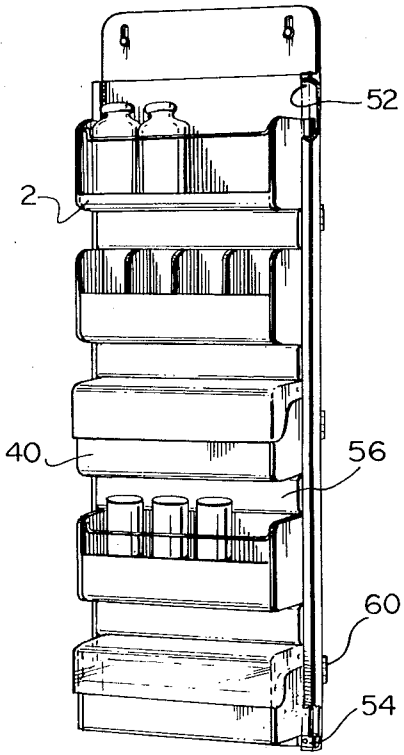
FIG. 4 is a perspective view of a plurality of storage racks according to the present invention mounted on a backing panel.
Figure 5:
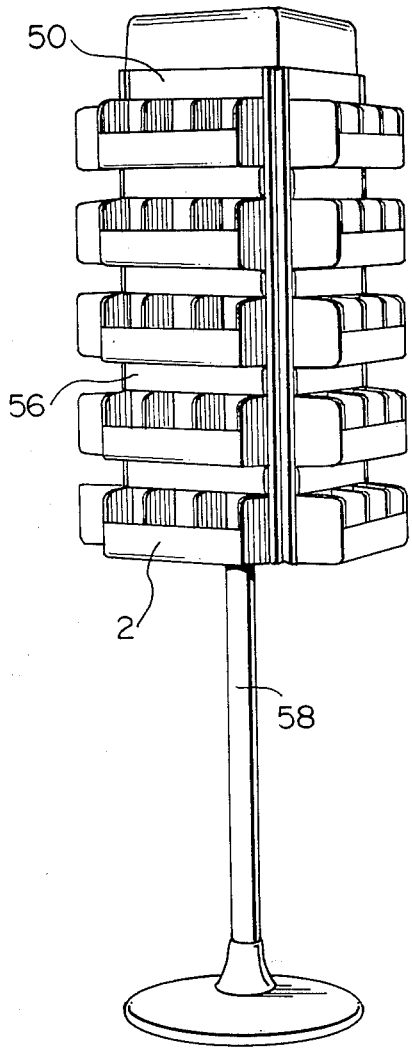
FIG. 5 is a perspective view, partially schematic, of a plurality of storage racks and backings mounted on a floor stand.

For mounting of racks 2 or 40, a backing panel 50 having spaced, parallel, inwardly oriented pairs of grooves 52 are provided. Pairs of grooves 52 receive opposite flanges 10 of racks 2 or 40 and secure these racks in position on the backing panels. A stop 54, which may be provided for example in each groove at a desired level and, upon which the lowest rack will sit, may be used to support the racks on the backing plate. Panels 56 of an appropriate width, and of a length such that its ends fit in grooves 52, may be used to space the individual racks on the backing panel appropriately. The racks are preferably spaced to facilitate placing of stock in, and removal from, individual racks on the backing panel. The backing panel may be wall mounted by nailing or bolting, for example, or, as illustrated in FIG. 5, may be mounted on a floor stand 58 for rack storage or display. As illustrated in FIG. 4, backing panels 50 may be provided with hinges at their sides, so that the backing panel and racks secured thereon may be hingedly mounted in an appropriate cabinet structure, for more efficient utilization of storage or display space.

It will be understood that the basic rack and rack system of the present invention lends itself to many different construction and application. Individual racks may be sub-divided as required of racks using the vertical partition sections 32, and varying arrangements of racks may be combined on each backing panel 50. As well, numerous different combinations of backing panels may be created for a desired display or storage purpose.

Thus there has been provided in accordance with the invention a storage rack and system that fully satisfies the objects, aims and advantages set forth above. While the invention has been described in conjunction with example embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. A rack for holding objects for storage or display comprising spaced planar sides normally vertically oriented, the sides of each having top, bottom, front and back edges, a rectangular base panel extending between the sides along the length of their bottom edges, a rectangular top panel extending between the sides along a portion of the length of their top edges from the back, the base and top panels being normally oriented substantially horizontally, a planar rectangular front panel normally vertically oriented, extending between the sides along a portion of the length of their front edges from the bottom, the rack having an open back, the back edges of the sides having outwardly, oppositely extending flanges for mounting the rack the top edge of the front panel, the front edge of the top panel and the sides defining a sufficient opening to the interior of the rack from the front or top for objects to be manually placed therein or removed therefrom.

2. A rack according to claim 1 wherein the side edges of the front panel and the sides of the rack are provided with means for releasably attaching the front panel to the sides so that the front panel may be removed as required.

3. A rack according to claim 2 wherein a bar is provided extending between the upper front areas of the sides to provide protection against objects supported on the base panel being accidently dislodged from the front.

4. A rack according to claim 1 wherein inner surfaces of at least two of the top panel, base panel and front panel are provided with a series of aligned, laterally extending pairs of spaced shoulders forming grooves therebetween to receive in normally vertical orientation from top to bottom and front to back alignment partition members to divide the interior of the rack into two or more sections.

5. A rack according to claim 4 further provided with one or more partitions fitted into co-operating grooves.

6. A rack according to claim 1 further provided with a flap pivotably secured to the rack which flap, in closed position, covers the opening to the interior of the rack from the front or top, and when in open position, exposes that opening for placement in or removal from the rack of objects.

7. A rack according to claim 6 wherein the flap is hinged for pivotal movement to the sides of the rack.

8. A rack according to claim 6 wherein the flap is transparent to enable the rack to be used for display purposes.

9. A rack according to claim 1 wherein spaced perforations are provided in the front panel to releasably receive at various locations securing means from label holders or label plates.

10. A storage system comprising one or more storage racks according to claim 1 and a planar backing section provided with spaced, parallel, inwardly oriented pairs of grooves to slidably receive the oppositely extending flanges of the rack in secure but releasable engagement.

11. A storage system according to claim 10 comprising a plurality of racks seated in the backing section and spaced from each other by planar spacer panels having opposite ends slidably received in the grooves, the plates being of a predetermined width and having upper and lower edges abutting adjacent racks.

12. A storage system according to claim 10 further provided with means for wall mounting of the backing panel.

13. A storage system according to claim 10 in which the backing panel is further provided with hinges along one side to be hingedly secured to a support structure.

14. A storage system according to claim 10 in which a plurality of backing panels are secured to a central floor stand.

15. A storage system comprising one or more storage racks for holding objects for storage or display, each rack comprising spaced planar sides normally vertically oriented, the sides of each having top, bottom, front and back edges, a rectangualr base panel extending between the sides along the length of their bottom edges, a rectangular top panel extending between the sides along a portion of the length of their top edges from the back, the base and top panels being normally oriented substantially horizontally, the rack having an open back, the back edges of the sides having outwardly, oppositely extending flanges for mounting the rack, a planar backing section provided with spaced, parallel, inwardly oriented pairs of grooves to slidably receive said flanges in secure but releasable engagement, hinges along one side of said backing section for hingedly securing the rack to a support structure said rack being provided with an opening to the interior of the rack from the front or top for objects to be manually placed therein or removed therefrom.

16. A storage system comprising a plurality of storage racks for holding objects for storage or display, each rack comprising spaced planar sides normally vertically oriented, the sides each having top, bottom, front and back edges, a rectangular base panel extending between the sides along the length of their bottom edges, a rectangular top panel extending between the sides along a portion of the length of their top edges from the back, the base and top panels being normally oriented substantially horizontally, the rack having an open back, the back edges of the sides having outwardly, oppositely extending flanges for mounting the rack, a planar backing section provided with spaced, parallel, inwardly oriented pairs of grooves to slidably receive said flanges in secure but releasable engagement, said rack being provided with an opening to the interior of the rack from the front or top for objects to be manually placed therein or removed therefrom; and a central floor stand secured to said backing panel of each rack.

* * * * *